US005514015A

United States Patent [19]

Okazawa et al.

[11] Patent Number: 5,514,015

[45] Date of Patent: May 7, 1996

[54] BREATHER STRUCTURE FOR OUTBOARD MOTOR

[75] Inventors: Goichi Okazawa; Yasuhiko Shibata; Hiroshi Nakai, all of Hamamatsu, Japan

[73] Assignee: Sanshin Kogyo Kabushiki Kaisha, Hamamatsu, Japan

[21] Appl. No.: 203,435

[22] Filed: Mar. 1, 1994

[30] Foreign Application Priority Data

Mar. 1, 1993 [JP] Japan ..... 5-062442

[51] Int. Cl.[6] ..... B63H 20/14

[52] U.S. Cl. ..... 440/88; 440/900

[58] Field of Search ..... 440/88, 900, 89; 123/41.86, 572, 574

[56] References Cited

U.S. PATENT DOCUMENTS 4,493,295 1/1985 Ampferer ..... 123/41.86
4,517,951 5/1985 Otaka et al. ..... 123/572
4,597,372 7/1986 Furukawa ..... 123/572
5,163,394 11/1992 Koishikawa et al. ..... 440/88

FOREIGN PATENT DOCUMENTS 2155998 10/1985 United Kingdom ..... 123/574

*Primary Examiner*—Edwin L. Swinehart
*Attorney, Agent, or Firm*—Knobbe, Martens, Olson & Bear

[57] ABSTRACT

Several embodiments of lubricating and breather systems for outboard motors that provide effective oil separation and which permits the blow-by gases to flow in a direction the same as the lubricant return to the lubricant tank so as to avoid flow restriction. The blow-by gases are then discharged to the atmosphere through a conduit that is separate from any of the lubricant return conduits. Oil separating arrangements are disclosed as are various positions for the oil separator including in the cam chamber of the engine or in the lubricant tank.

20 Claims, 6 Drawing Sheets

BREATHER STRUCTURE FOR OUTBOARD MOTOR

BACKGROUND OF THE INVENTION

This invention relates to an outboard motor and more particularly to an improved breather arrangement for an internal combustion engine.

It is well known that it is desirable to ventilate the components of an internal combustion engine such as the crankcase chamber and the cam chamber. Frequently, the air circulated through these chambers comprises blow-by gases which pass the pistons and cylinder bore and then flow into the crankcase chamber. A portion of these gases are circulated through the cam shaft chamber for its circulation. The circulated gases are then normally passed through an oil separator so as to extract oil from the gases and the gases are then discharged. The gases may be discharged either directly to the atmosphere or to the induction system for the engine for further burning in the combustion chamber so as to reduce the emission of hydrocarbons and other unwanted components.

In addition to the ventilation, the engine also employs a lubricating system and this involves delivery of lubricant to the crankcase chamber and the cam chamber. This lubricant is then drained back to the oil tank for recirculation. Frequently, the ventilating air return and the oil return is through the same conduit and at times the flow is in opposite directions. This can retard either the flow of oil back to the oil tank or the flow of crankcase gases to the respective chambers.

These problems are particularly acute when the engine is employed in conjunction with an outboard motor. It is normal outboard motor practice to place the engine so that its output shaft (the crankshaft) rotates about a vertically extending axis. When this is done the crankcase chamber does not serve the function as the oil tank and a separate oil tank is required. Thus, lubricant must be drained back to this separate oil tank from both the crankcase chamber and the cam chamber and ventilating gases also must flow between these chambers. This further aggravates the problem of ensuring good ventilation and good oil draining.

It is, therefore, a principal object of this invention to provide an improved breather arrangement for an internal combustion engine.

It is a further object of this invention to provide an improved breather arrangement for an outboard motor.

As has been noted, it is frequently the practice to provide an oil separator for the crankcase ventilation gases to separate oil from the gases before the gases are discharged. The use of such oil separators has obvious advantages, but provides additional difficulties in conjunction with outboard motors. As is well known, the construction of an outboard motor is extremely compact and if the oil separator is positioned externally of the engine, it can increase the dimensions of the engine, particularly the height, which is not desirable.

It is, therefore, the further object of this invention to provide an improved oil separating arrangement for the breather system of an internal combustion engine.

SUMMARY OF THE INVENTION

This invention is adapted to be embodied in an outboard motor that is comprised of a cylinder block cylinder head assembly having a crankcase chamber at one side thereof in which a crankshaft rotates about a vertically disposed axis and a cam chamber formed at the other side thereof. A lubricant tank is suspended beneath the engine and contains lubricant for the engine. Return passage means are provided for delivering lubricant and blow-by gases from the cam chamber and crankcase chamber to the lubricant tank. A separate breather passage is provided for discharging blow-by gases only from the lubricant tank at a point above the lubricant level therein.

DETAILED DESCRIPTION OF THE PREFERRED EMBODIMENTS OF THE INVENTION

Figure 1:
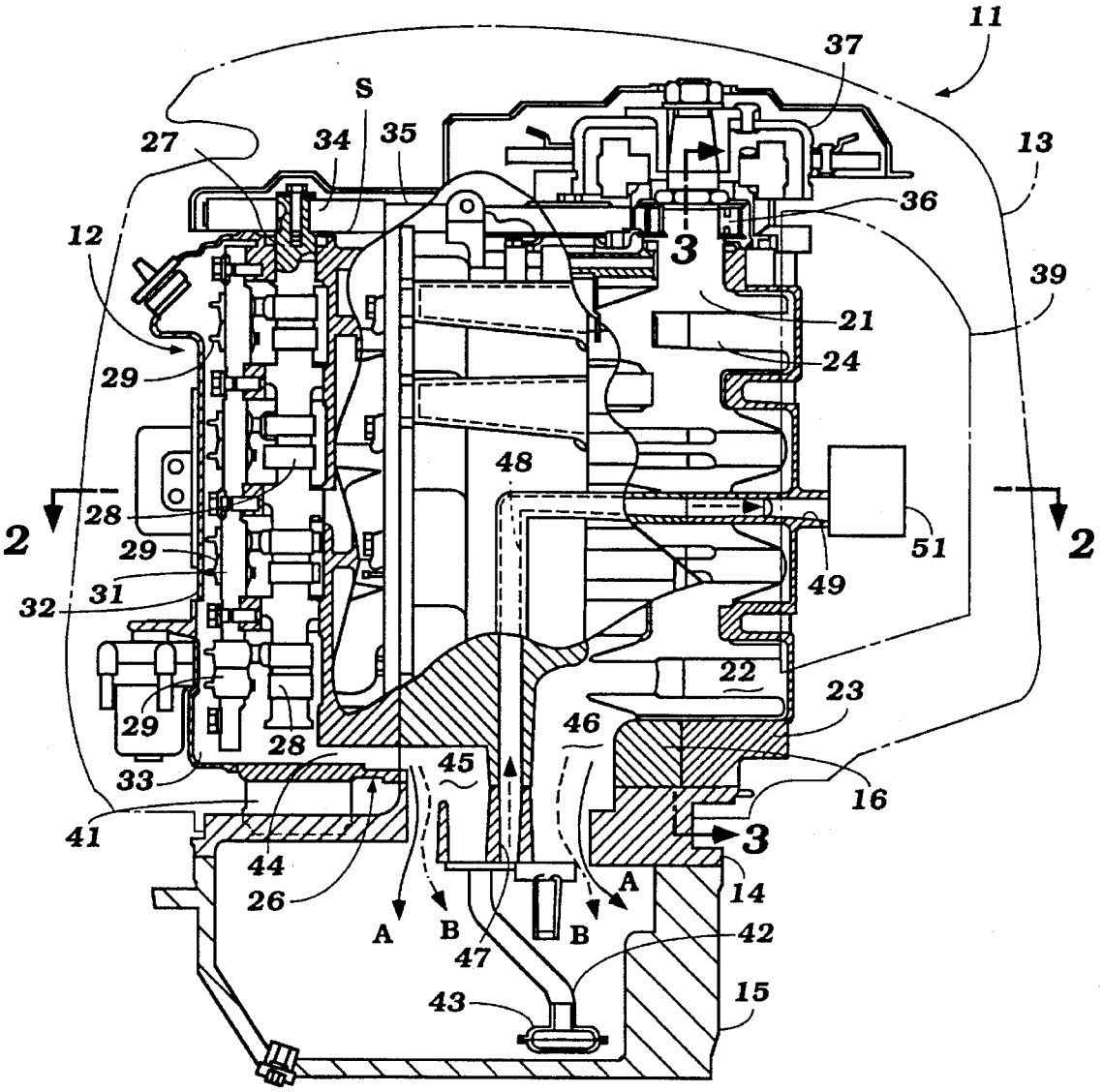
FIG. 1 is a partial side elevational view of an outboard motor, with parts shown in phantom and other portions broken away and shown in cross section, constructed in accordance with a first embodiment of the invention.
Figure 2:
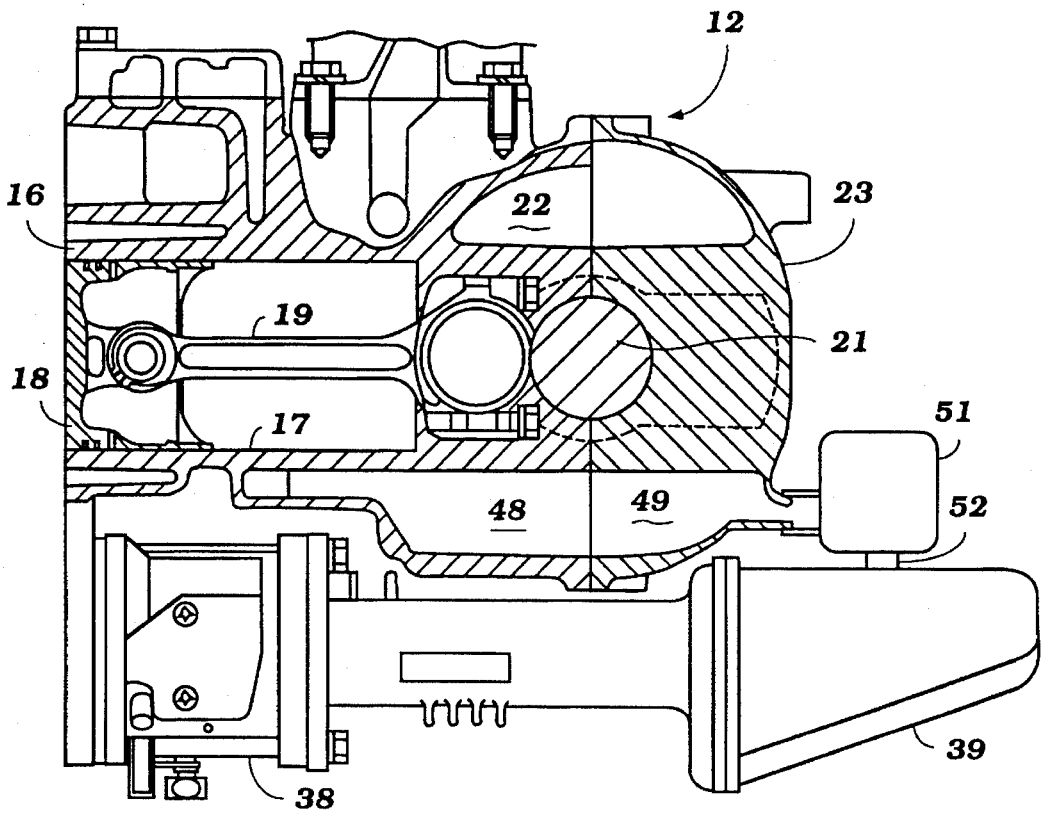
FIG. 2 is a cross-sectional view taken along the line 2—2 of FIG. 1.
Figure 3:
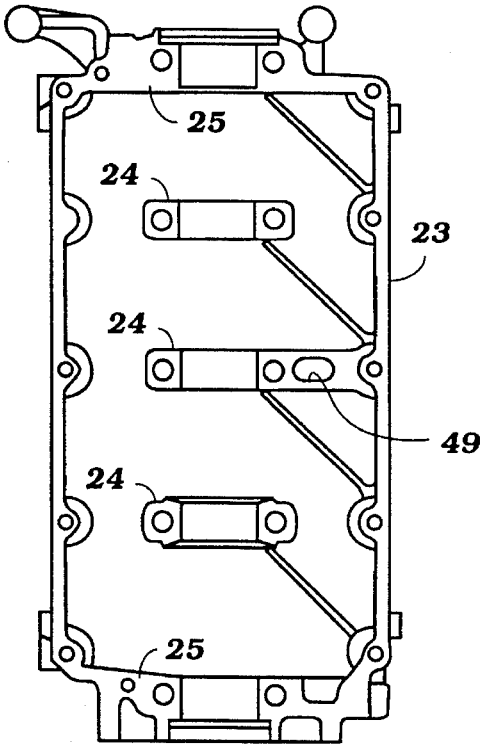
FIG. 3 is a cross-sectional view taken along the line 3—3 of FIG. 2 and shows the formation of the breather passage.
Figure 4:
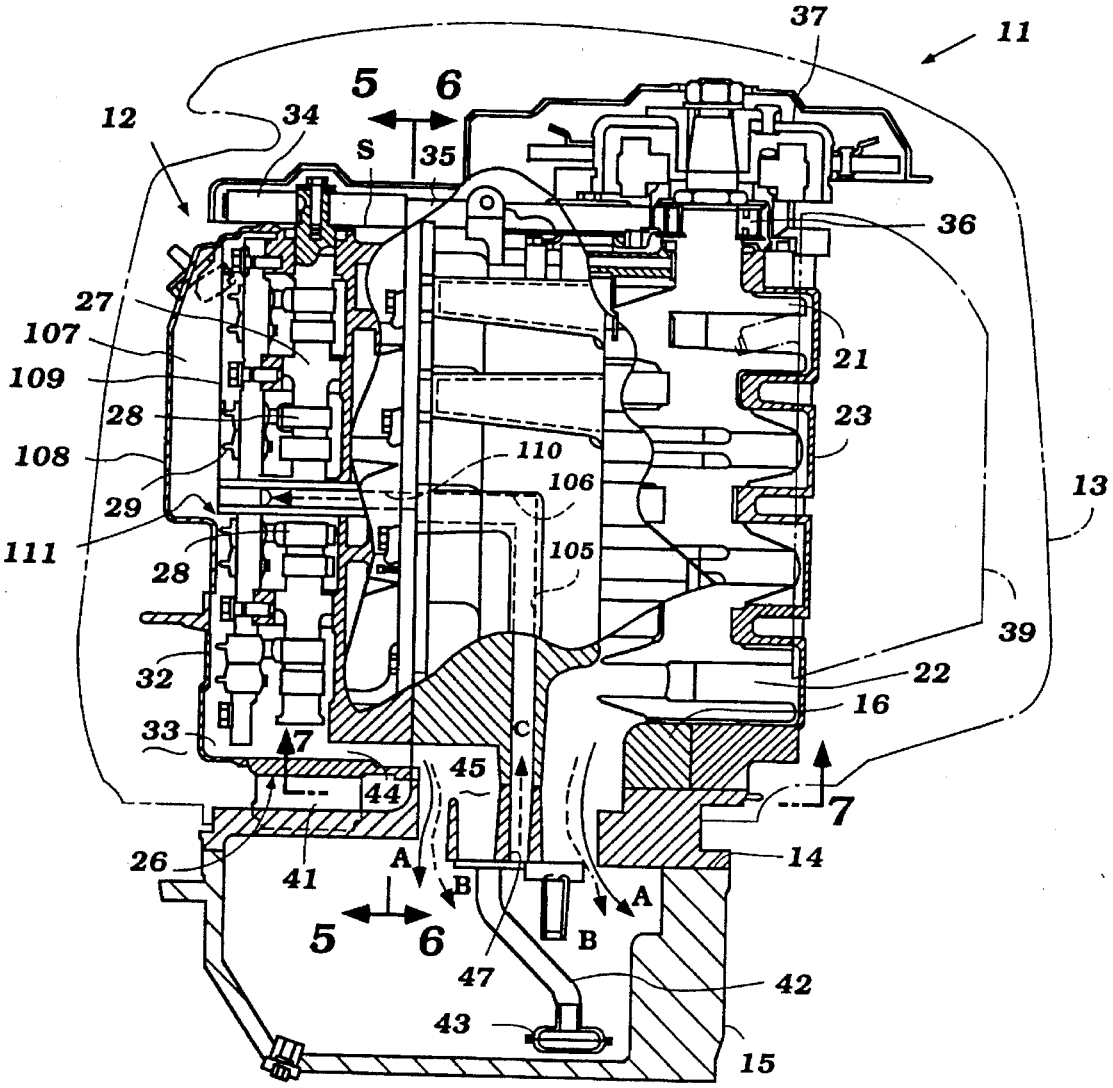
FIG. 4 is a partial side elevational view, with portions shown in cross section and broken away and other portions shown in phantom, of an outboard motor constructed in accordance with another embodiment of the invention.
Figure 5:
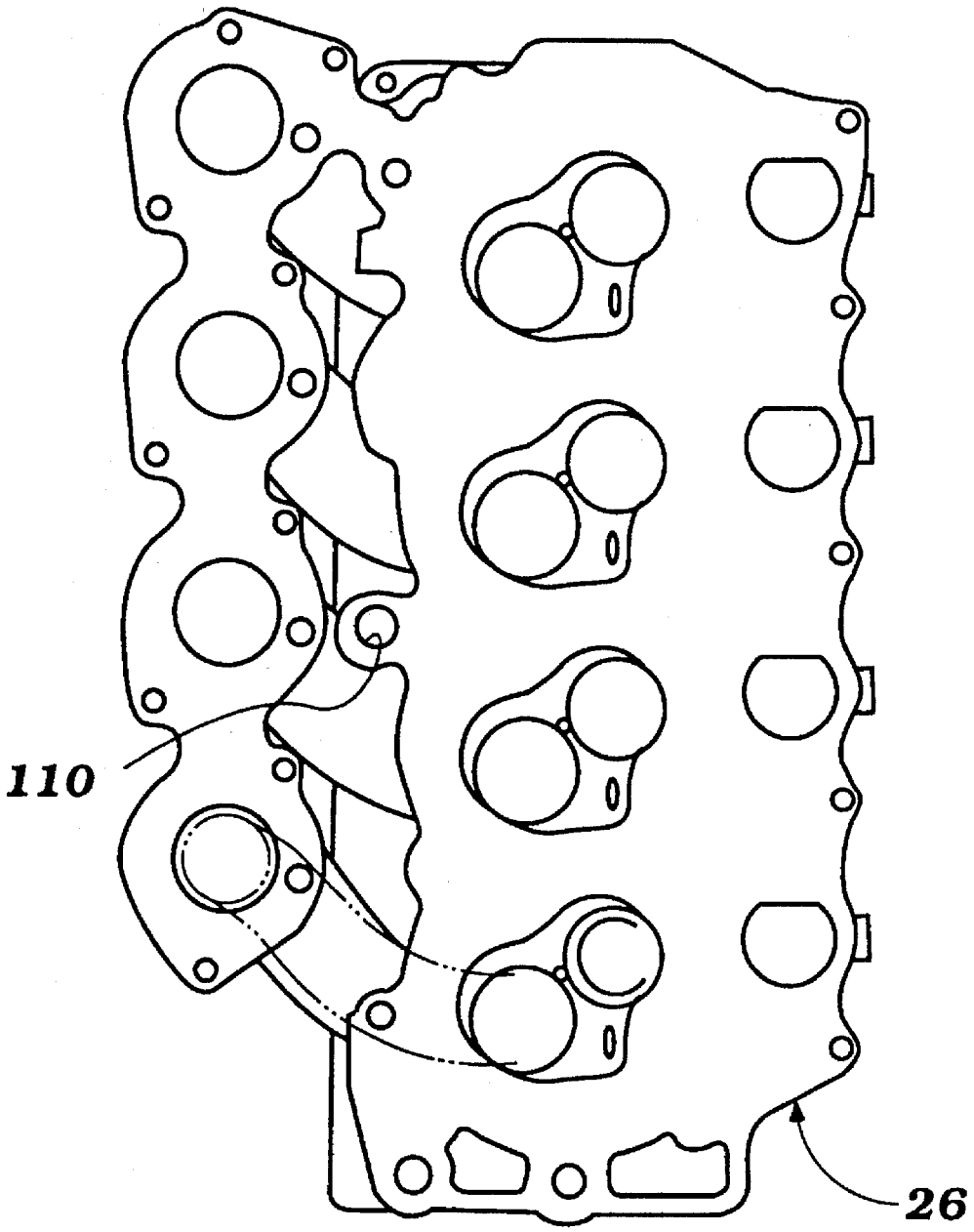
FIG. 5 is a cross-sectional view taken along the line 5—5 of FIG. 4.
Figure 6:
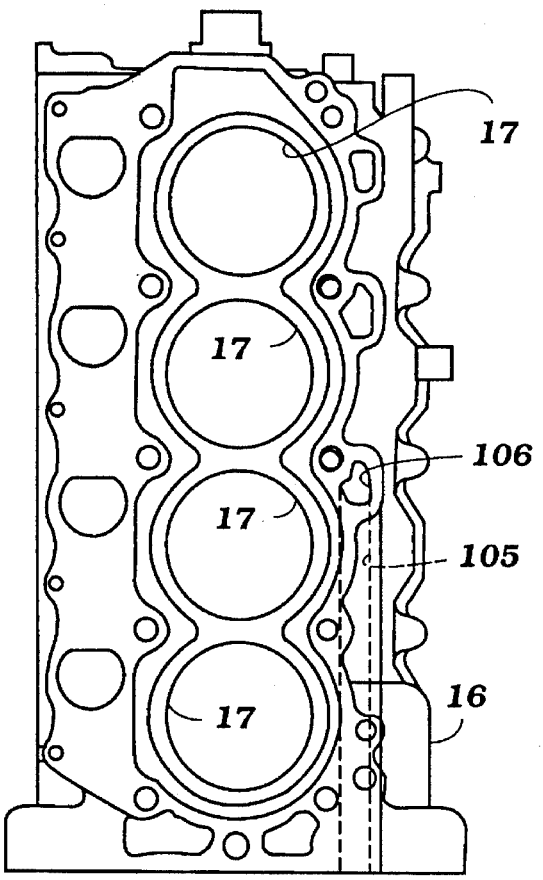
FIG. 6 is a cross-sectional view taken along the line 6—6 of FIG. 4.
Figure 7:
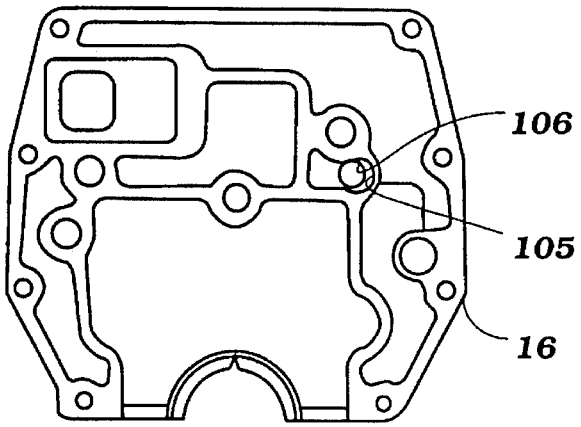
FIG. 7 is a cross-sectional view taken along the line 7—7 of FIG. 4.

Referring first to the embodiment of FIGS. 1–3, an outboard motor constructed in accordance with this embodiment is shown partially and is identified generally by the reference numeral 11. Since the invention deals primarily with the engine of the outboard motor, only the upper portion of the outboard motor 11 is illustrated and certain components, as will be noted, will be shown in phantom.

The outboard motor 11 includes a power head comprised of a powering internal combustion engine, indicated generally by the reference numeral 12, and a surrounding protective cowling shown in phantom and identified by the reference numeral 13. As will be noted, the engine 12 is of the four cylinder in-line type although it will be readily apparent to those skilled in the art how the invention can be employed with engines having other cylinder numbers and other cylinder placement. In addition, the engine 12 operates on the four cycle principle and the invention has particular utility with four cycle engines because of the type of lubricating systems they employ.

The power head thus far described is mounted on a spacer plate 14 which is positioned at the lower end of the power head and also which is connected to the upper portion of the drive shaft housing (not shown) and into which an oil tank 15 depends.

The remaining components of the outboard motor 11 are not significant insofar as the invention is concerned and, for that reason, they are not illustrated. As will become apparent to those skilled in the art, the invention may be utilized with a wide variety of types of conventional outboard motors.

The engine 12, as has been previously noted, is of the four cylinder in-line type and includes a cylinder block 16 in which the four aligned cylinder bores 17 are formed in any known manner. The engine 12, as is typical with outboard motor practice, is disposed so that the cylinder bores 17 extend horizontally. Pistons 18 reciprocate in the cylinder bores 17 and are connected by means of connecting rods 19 to a crankshaft 21. The crankshaft 21 is journalled for rotation about a vertically extending axis within a crankcase chamber, indicated generally by the reference numeral 22.

This rotational support is provided by means of a crankcase member 23 that is affixed to the cylinder block 16 in a well known manner. The crankcase member 23 is formed with a plurality of spaced bearing portions 24 that cooperate with corresponding bearing portions of the cylinder block 16 for journaling the intermediate main bearings of the crankshaft 21. In addition, end main bearings 25 are formed at the ends of the crankcase member 23 for journaling the end main bearings of the crankshaft 21 as is well known in this art.

A cylinder head assembly, indicated generally by the reference numeral 26 is affixed to the side of the cylinder block 16 opposite to the crankcase member 23 in a known manner. The cylinder head assembly 26 journals a cam shaft 27 having a plurality of cam lobes 28 which cooperate with rocker arms 29 carried on a rocker arm shaft 31 which is also journalled in the cylinder head assembly 26 in a known manner. These rocker arms 29 operate intake and exhaust valves (not shown) associated with each of the cylinder bores 17. This cam shaft mechanism is enclosed by a cam cover 32 that is affixed to the cylinder head 26 and which defines a cam chamber 33.

The cam shaft 27 has a sprocket 34 affixed to its upper end which is driven by a drive belt 35 which is, in turn, driven by a driving sprocket 36 affixed to the upper end of the crankshaft 21. A flywheel magneto 37 is affixed to the crankshaft 21 above the driving sprocket 36 and provides electrical energy for the ignition system of the engine 12 and for other auxiliary purposes, if desired.

The engine 12 is provided with an induction system that includes one or more carburetors 38 that receive an air charge from an air inlet device 39 which includes a silencer section and which draws air from the interior of the protective cowling 13. A suitable air inlet is provided in the protective cowling 13 for supplying air to the interior of the protective cowling 13 for consumption by the engine 12, as is well known in this art.

The construction of the engine 12 as thus far described may be considered to be conventional and since the invention deals primarily with the ventilating and lubricating system for the engine, other details of the engine not already described may be considered to be conventional.

As has already been noted, the lubricating system includes an oil tank 15 that depends from the spacer plate 14 and which is positioned in the upper end of the drive shaft housing of the outboard motor. A lubricating pump 41 is driven off the lower end of the cam shaft 27 in any suitable manner and draws lubricant from the lubricant tank 15 through a pickup 42 having a strainer 43 disposed at its lower or submerged end. This lubricant is then circulated through any appropriate supply system to the cam chamber 33 for lubrication of the bearings for the cam shaft 28 and also for the rocker arms 29. This lubricant is then drained back to the lubricant tank 15 through a return path comprised of a first portion 44 formed in the lower end of the cylinder head 26 and which communicates with a passageway 45 formed in the cylinder block 16 and which discharges directly into the upper portion of the lubricant tank 15 as shown by the arrow A in FIG. 1.

In a like manner, the lubricant pump 41 delivers lubricant to the crankshaft 21 and its main bearings through any suitable lubrication system. This may also include means for lubricating the connecting rods 19 both at their lower journals to the crankshaft 21 and at their upper journal to the pistons 18 through the respective piston pins. This lubricant is then drained back to the lubricant tank 15 through a return conduit 46 formed in the lower end of the cylinder block 16 along a path shown by the arrow A.

As is well known, it is desirable to provide a ventilating airflow through the crankcase chamber 22 and cam chamber 33. Rather than drawing direct atmospheric air, the blow-by gases that blow by the pistons 18 are delivered to the crankcase chambers 22 and a portion of these blow-by gases are delivered from the crankcase chamber 22 to the cam chamber 33 through an appropriate passage formed in the cylinder block 16 (not shown) as is well known in this art. These blow-by gases are delivered to the oil tank 15 through the passages 44 and 45 (from the cam chamber 33) and through the passage 46 (from the crankcase chamber 22) as shown by the arrows B. Hence, the crankcase ventilating gases which comprise primarily blow-by gases flow in the same direction as the lubricant that is being returned to the oil tank 15 and hence neither flow will interfere with the other.

These blow-by gases are then exhausted from the oil tank 15 through a passage system that is provided exclusively for the flow of the crankcase ventilation gases. That is, this passageway does not serve any function for transporting lubricant, except for returning lubricant that is separated from the crankcase ventilation gases back to the oil tank 15. In this embodiment, this ventilating gas system includes a first passageway 47 formed in the spacer plate 14 and which extends vertically upwardly to meet with a further passageway 48 formed directly in the cylinder block 16. This passageway 48 communicates with a further passageway 49 which is formed integrally within the crankcase member 23 by a cored or drilled passageway formed in one of the main bearing journal portions 24 (FIG. 3). Because of the fact that the passageways 47 and 48 extend vertically upwardly they will form an oil separator function that will cause oil to be separated from the crankcase ventilating gases and return by gravity to the oil tank 15.

In addition, a breather chamber or separator 51 is positioned externally of the engine but below the upper surface S thereof. This oil separator will tend to remove any additional lubricant that can flow back to the oil tank 15. A small passageway 52 interconnects the oil separator or breather chamber 51 with the air inlet device 39 so that rather than being discharged directly to the atmosphere, the crankcase ventilating gases will be passed back to the combustion chambers of the engine so that any hydrocarbons that remain therein can be removed by burning within the combustion chamber.

Referring now to the embodiment of FIGS. 4–7, this embodiment is basically the same as the embodiment of FIGS. 1–3 except for the way in which oil separation is accomplished and the way in which the oil separator or breather chamber is formed. Since the basic engine construction is the same, components which are the same or substantially the same have been identified by the same reference numerals and will be described again only insofar as is necessary to understand the construction and operation of this embodiment.

The oil return system in this embodiment is the same as the previously described embodiment but the ventilation system for returning the ventilating gases from the oil pan 15 is different but still employs the passage 47 formed in the spacer plate 14. This passage extends vertically as in the previously described embodiment and communicates with a passageway 105 formed integrally in the cylinder block 16 which also has a vertically extending portion.

In this embodiment, however, the upper end of the passageway 105 meets a horizontally extending passageway 106 that extends toward the cylinder head 26 and communicates with a horizontally extending passageway 110 formed integrally therein. This passageway extends through the cylinder head to a breather chamber or separator 107 formed by a protruding portion 108 of the cam cover 32 and an internal baffle 109. This separator or breather chamber 107 has a return path 111 formed at the lower end thereof so any oil which has not been separated by passing through the vertical passageways 46 and 105 and/or horizontal passageways 106 and 110 can condense in the breather chamber 107 and be returned to their cam chamber 33. This lubricant will then return to the oil pan 15 through the return path indicated by the arrow A.

The ventilating gases may be withdrawn from the breather or separator chamber 107 and delivered to the air inlet device 39 through a separate external conduit. Hence, this embodiment requires a separate external conduit which is not required in the previous embodiment but has the advantage of still maintaining the breather separator chamber 107 below the upper end face S of the engine 12.

Figure 8:
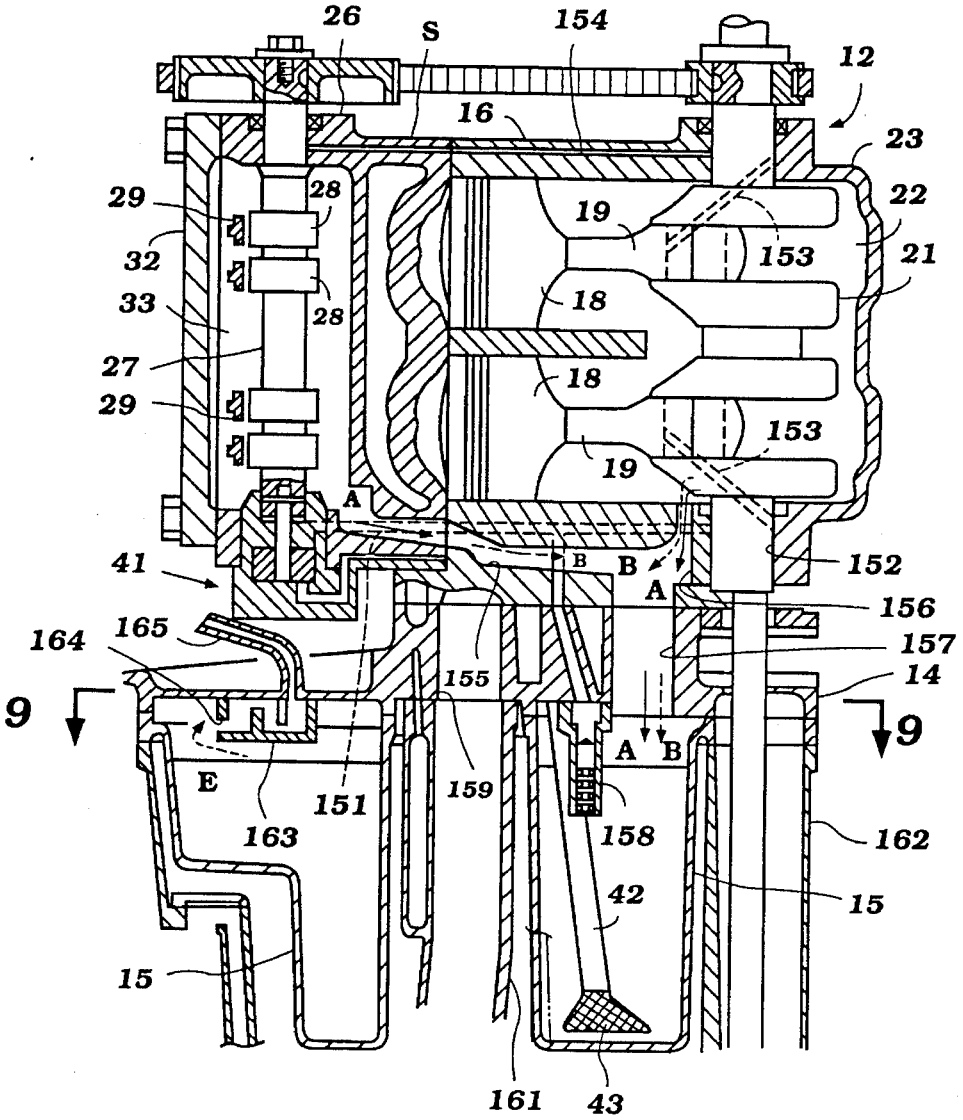
FIG. 8 is a view, in part similar to FIGS. 1 and 4 of a further embodiment of the invention, with the protective cowling being removed and the outboard motor shown primarily in cross section.
Figure 9:
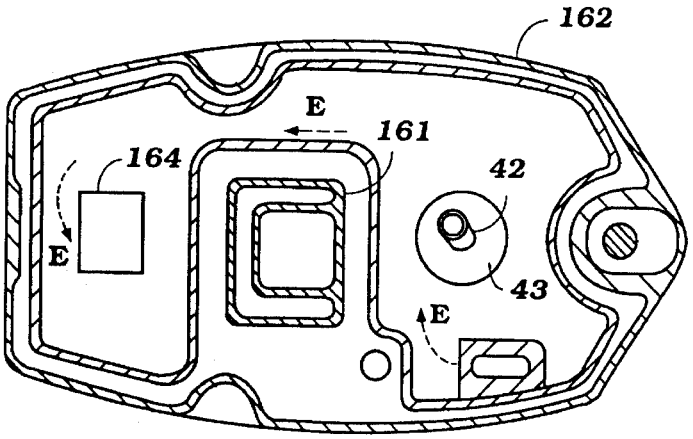
FIG. 9 is a cross-sectional view taken along the line 9—9 of FIG. 8.

FIGS. 8 and 9 show a still further embodiment of the invention which is generally similar to the embodiments previously described and where that is the case the components have been identified by the same reference numerals. This embodiment illustrates a two-cylinder in-line engine and as has been previously noted the invention can be employed readily with engines having any number of cylinders and cylinder placement.

There are some components of the engine 12 that are shown in more detail in this figure and this includes the lubricating path from the oil pump 41 and in view of this that construction will be described so as to permit those skilled in the art to understand how the engine is lubricated. The lubricant pump 41 draws the lubricant from the lubricant tank 15 through the strainer 43 and pickup tube 42 as already described. Lubricant is supplied from the pump 41 to a passageway 151 formed in the cylinder head 26 and cylinder block 16 for delivery to a lower main bearing 152 of the crankshaft 21. The crankshaft 152 is provided with cross drillings 153 for supply of lubricant to its main and rod bearings and this passageway communicates with a further passageway 154 formed in the upper end of the cylinder block 16 and cylinder head 26 for delivery to the cam shaft 27 at the upper end thereof. The lubricant then flows downwardly by gravity to lubricate the cam lobes 28 and rocker arms 29.

In this embodiment, the cam chamber 33 communicates with a common return passageway 155 formed in the cylinder block 16 that communicates with a further return passageway 156 formed in a downwardly extending direction that communicates with a single return passageway 157 that communicates with the oil tank 15 for return of lubricant thereto.

A pressure relief valve 158 is t-ed off of the conduit 151 so as to control the maximum pressure exerted within the lubrication system.

The blow-by gases from the crankcase chamber 22 are delivered to the cam chamber 33 in a known manner and return along the flow path B to the oil pan 15 as previously described.

This embodiment also shows the exhaust passage 159 formed in the spacer plate 14 which communicates with an exhaust pipe 161 which depends into the drive shaft housing, shown in these figures and identified by the reference numeral 162. The oil tank 15 encircles the exhaust pipe 161 but is spaced outwardly therefrom.

In this embodiment, a separator, breather chamber 163 is affixed to the undersigned of the spacer plate 14 directly above the liquid level in the oil tank 15 and has an inlet opening 164 that receives the ventilating gases as shown by the arrow E. There is a labyrinthine construction within the chamber 163 and a discharge conduit 155 is provided for discharging the ventilating gases with the lubricant being separated and returned back to the oil tank 15 through the inlet passage 164. The conduit 165 may either discharge either directly to the atmosphere or back to the air inlet device as previously described.

It should be readily apparent that the described constructions provide a very good ventilating system for the interior of an engine wherein the ventilating gases will now flow counter to the flow of lubricant and hence there will be no restriction of the flow of either. Also, the constructions minimize the use of external conduit and thus provide a system that can have a long life and does not require servicing. Of course, the foregoing description is that of preferred embodiments of the invention and various changes and modifications may be made without departing from the spirit and scope of the invention, as defined by the appended claims.

We claim:

1. An outboard motor comprised of a cylinder block, cylinder head assembly having a crankcase chamber at one side thereof and which a crankshaft rotates about a vertically disposed axis and a cam chamber formed at the other side thereof, a lubricant tank suspend beneath said engine and containing lubricant for said engine, return passage means having an inlet disposed at a lower portion of at least one of said chambers and an outlet for delivering lubricant and blow-by gases to said lubricant tank, and a breather passage for discharging blow-by gases only from said lubricant tank at a point above the liquid level therein and terminating well above said outlet.

2. The outboard motor as defined in claim 1, further including oil separating means provided in said breather passage.

3. The outboard motor as defined in claim 2, wherein the oil separator means drains the separated lubricant back to the lubricant tank through the breather passage.

4. The outboard motor as defined in claim 3, wherein the oil separating means comprises at least a vertically extending section of the breather passage.

5. The outboard motor as defined in claim 3, wherein the breather passage passes at least in part through one of the crankcase and cam chambers.

6. The outboard motor as defined in claim 5, wherein the breather passage passes through the cam chamber.

7. The outboard motor as defined in claim 6, wherein the breather passage terminates in the cam chamber and the lubricant separating means includes a lubricant separator formed within the cam chamber with the separated lubricant being drained back to the cam chamber.

8. The outboard motor as defined in claim 3, wherein the breather passage passes in part through the crankcase chamber through a passage formed integrally in the cylinder block cylinder head assembly and in intergrally a crankcase member affixed to the cylinder block cylinder head assembly and defining therewith the crankcase chamber.

9. The outboard motor as defined in claim 8, wherein the passage formed in the crankcase member is formed in a part of the crankcase member that forms a journal for the engine crankshaft.

10. The outboard motor as defined in claim 3, wherein the breather passage means includes at least in part a passage formed integrally in the cylinder head cylinder block assembly.

11. The outboard motor as defined in claim 10, wherein the breather passage discharges the blow-by gases into an induction system for the engine.

12. The outboard motor as defined in claim 10, wherein the breather passage discharges the blow-by gases into the crankcase chamber.

13. The outboard motor as defined in claim 12, wherein the breather passage discharges the blow-by gases to a breather chamber, lubricant separator formed at least in part within the cam chamber.

14. The outboard motor as defined in claim 13, wherein the breather chamber, lubricant separator in the cam chamber drains the separated lubricant back into the cam chamber.

15. The outboard motor as defined in claim 1, wherein the breather passage means includes a breather chamber defining a volume that is effective for separating lubricant from the blow-by gases.

16. The outboard motor as defined in claim 15, further including a discharge conduit extending from the breather chamber to a point for discharging the blow-by gases once they have passed through the breather chamber.

17. The outboard motor as defined in claim 16, wherein the blow-by gases are discharged into the air induction system for the engine.

18. The outboard motor as defined in claim 16, wherein the blow-by gases are discharged to within the cam chamber.

19. The outboard motor as defined in claim 18, wherein the breather passage discharges the blow-by gases to a breather chamber, and lubricant separator formed at least in part within the cam chamber.

20. The outboard motor as defined in claim 16, wherein the breather chamber, lubricant separator is positioned in the lubricant tank at a point above the lubricant level therein.

* * * * *